US009851653B2

(12) United States Patent
Kitagawa et al.

(10) Patent No.: US 9,851,653 B2
(45) Date of Patent: Dec. 26, 2017

(54) CHARGING DEVICE AND IMAGE FORMING APPARATUS INCLUDING MOVABLE MEMBER TO WHICH CLEANING MEMBER IS ATTACHED

(71) Applicant: FUJI XEROX CO., LTD., Tokyo (JP)

(72) Inventors: Yusuke Kitagawa, Kanagawa (JP); Akiko Kimura, Kanagawa (JP); Yasuo Takayama, Kanagawa (JP); Sadao Okano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/243,240

(22) Filed: Aug. 22, 2016

(65) Prior Publication Data

US 2017/0205726 A1 Jul. 20, 2017

(30) Foreign Application Priority Data

Jan. 19, 2016 (JP) ..... 2016-007852
Jan. 19, 2016 (JP) ..... 2016-007853

(51) Int. Cl.
*G03G 15/02* (2006.01)

(52) U.S. Cl.
CPC ..... *G03G 15/0258* (2013.01)

(58) Field of Classification Search
CPC ..... G03G 15/0225; G03G 15/0258; G03G 15/0291
USPC ..... 399/100
See application file for complete search history.

(56) References Cited

U.S. PATENT DOCUMENTS 7,978,990 B2 * 7/2011 Tajima ..... G03G 15/0258 399/100
8,744,301 B2 * 6/2014 Yoneda et al. ..... G03G 15/0291 399/100

FOREIGN PATENT DOCUMENTS

JP 09-119499 A 5/1997
JP 2002-333763 A 11/2002

* cited by examiner

*Primary Examiner* — William J Royer
(74) *Attorney, Agent, or Firm* — Sughrue Mion, PLLC

(57) ABSTRACT

A charging device includes an electrode, a cleaning member that moves along the electrode and cleans the electrode, a rotating member that is disposed along the electrode, includes a spiral protruding portion on an outer circumferential surface thereof, and circumferentially rotates, and a movable member to which the cleaning member is attached. The movable member includes a first through hole through which the rotating member passes, a first pressed portion that is provided on an inner circumferential surface of the first through hole and pressed by the protruding portion of the rotating member, and a second pressed portion that is disposed at a different position from a position of the first pressed portion in an axial direction of the rotating member and that is disposed such that one or more turns of the protruding portion are positioned between the second pressed portion and the first pressed portion.

10 Claims, 12 Drawing Sheets

CHARGING DEVICE AND IMAGE FORMING APPARATUS INCLUDING MOVABLE MEMBER TO WHICH CLEANING MEMBER IS ATTACHED

CROSS-REFERENCE TO RELATED APPLICATIONS

This application is based on and claims priority under 35 USC 119 from Japanese Patent Application No. 2016-007853 filed Jan. 19, 2016 and Japanese Patent Application No. 2016-007852 filed Jan. 19, 2016.

BACKGROUND

Technical Field

The present invention relates to a charging device and an image forming apparatus.

SUMMARY

According to an aspect of the invention, a charging device includes an electrode, a cleaning member that moves along the electrode and cleans the electrode, a rotating member that is disposed along the electrode, includes a spiral protruding portion on an outer circumferential surface thereof, and circumferentially rotates, and a movable member to which the cleaning member is attached. The movable member includes a first through hole through which the rotating member passes, a first pressed portion that is provided on an inner circumferential surface of the first through hole and pressed by the protruding portion of the rotating member, and a second pressed portion that is disposed at a different position from a position of the first pressed portion in an axial direction of the rotating member and that is disposed such that one or more turns of the protruding portion are positioned between the second pressed portion and the first pressed portion. The second pressed portion is pressed by the protruding portion. Upon receiving driving power from the rotating member, the movable member moves in the axial direction of the rotating member.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described in detail with reference to the accompanying drawings.

Figure 1:
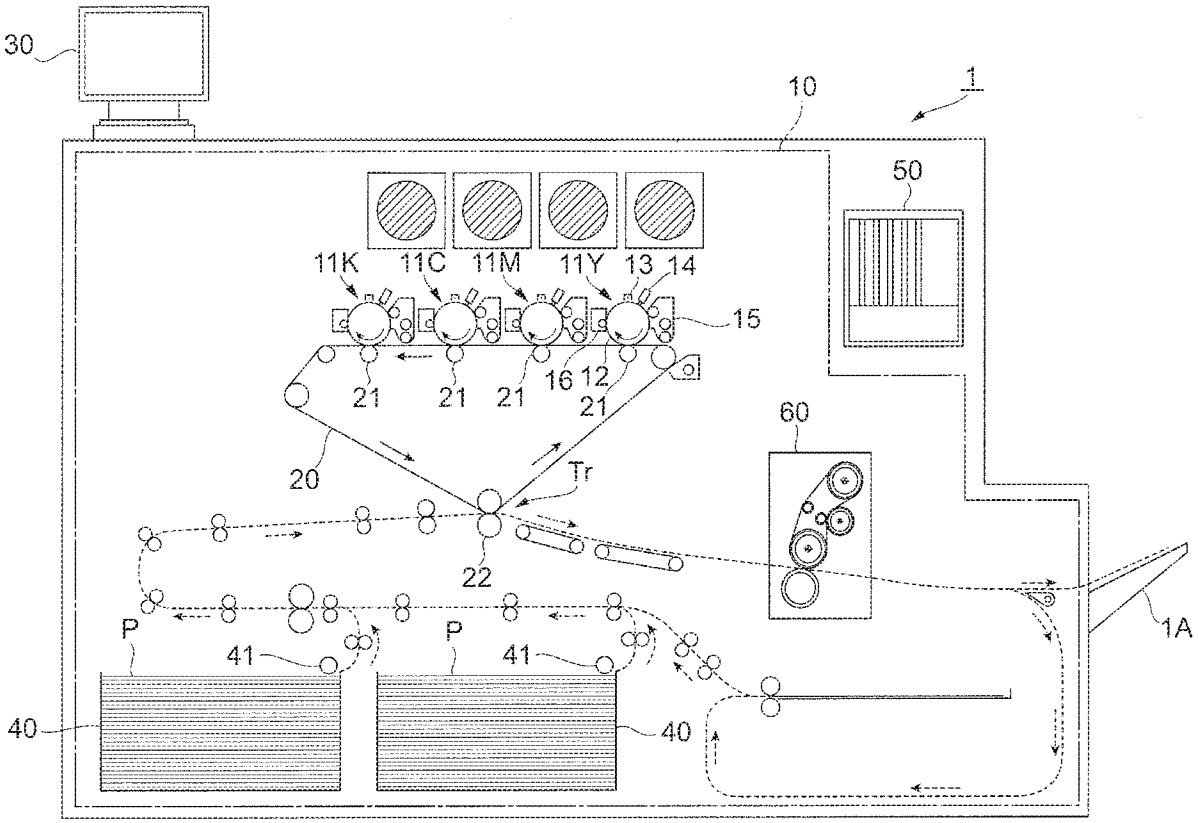
FIG. 1 is a view illustrating an exemplary configuration of an image forming apparatus.

FIG. 1 is a view illustrating an exemplary configuration of an image forming apparatus 1 according to an exemplary embodiment of the present invention.

The image forming apparatus 1 illustrated in FIG. 1 is a so-called tandem type color printer, and includes an image forming device 10 that forms an image based on image data. Further, the image forming apparatus 1 is provided with a main controller 50.

The main controller 50 is configured with a program-controlled central processing unit (CPU), and performs, for example, an operation control of each device and each functional unit provided in the image forming apparatus 1, a communication with a personal computer, etc., or a processing of image data.

Further, the image forming apparatus 1 is provided with a user interface unit 30 that receives an operation input from a user or displays various kinds of information to a user.

The image forming device 10 is a functional unit that forms an image by using, for example, an electrophotographic method, and includes four (4) image forming units which include a yellow (Y) image forming unit 11Y, a magenta (M) image forming unit 11M, a cyan (C) image forming unit 11C, and a black (K) image forming unit 11K.

In the following descriptions, the respective image forming units will be referred to as "image forming units 11" unless they should be expressed to be particularly discriminated from each other.

The image forming unit 11Y, the image forming unit 11M, the image forming unit 11C, and the image forming unit 11K form a yellow toner image, a magenta toner image, a cyan toner image, and a black toner image, respectively.

The image forming units 11 are provided with photoconductor drums 12, respectively, as an example of image carriers. Each photoconductor drum 12 is formed in a cylindrical shape. In addition, the photoconductor drum 12 is rotatably provided and circumferentially rotates by a motor (not illustrated). The photoconductor drum 12 holds a toner image formed on the outer circumferential surface thereof.

More specifically, in the present exemplary embodiment, an electrostatic latent image is formed on the surface of the photoconductor drum 12, and subsequently, a development is carried out by a toner. Therefore, a toner image is formed on the surface of the photoconductor drum 12, and the toner image is temporarily held by the photoconductor drum 12.

Further, the image forming units 11 are provided with charging devices 13, respectively, that charge the surfaces of the photoconductor drums 12, and exposure devices 14, respectively, that expose the photoconductor drums 12 charged by the charging devices 13 based on the image data.

Further, the image forming units 11 are provided with developing devices 15, respectively, that develop the electrostatic latent images formed on the photoconductor drums 12 by using color toners, and cleaners 16, respectively, that clean the surfaces of the photoconductor drums 12 after the transfer.

In addition, the image forming units 11 have the same configuration, except for the toners accommodated in the image developing devices 15.

Further, the image forming device 10 is provided with an intermediate transfer belt 20 to which the color toner images formed on the photoconductor drums 12 of the image forming units 11 are transferred, and primary transfer rolls 21 that transfer (primarily transfer) the color toner images formed by the image forming units 11 to the intermediate transfer belt 20.

Further, the image forming device 10 is provided with secondary transfer rolls 22 that transfer (secondarily transfer) the color toner images superposed and transferred onto the intermediate transfer belt 20, to a recording material P such as paper at one time. Further, the image forming device is provided with a fixing device 60 that fixes the secondarily transferred color toner images onto the recording material P.

In the present exemplary embodiment, hereinafter, the region where the secondary transfer rolls 22 are disposed and the color toner images on the intermediate transfer belt 20 are secondarily transferred to the recording material P will be referred to as a secondary transfer region Tr.

The operation of the image forming apparatus 1 will be described.

When forming an image, the image forming units 11 form black, cyan, magenta, and yellow color toner images, respectively, through the electrophotographic processes.

The color toner images formed by the respective image forming units 11 are sequentially and primarily transferred to the intermediate transfer belt 20 by the primary transfer rolls 21, and toner images with the color toners superposed thereon are formed on the intermediate transfer belt 20.

The toner images on the intermediate transfer belt 20 are transported, with the movement of the intermediate transfer belt 20, to the secondary transfer region Tr where the secondary transfer rolls 22 are disposed.

In a recording material transport system, the recording material P, which has been dispensed by a dispensing roll 41 from a recording material accommodating container 40, is transported along a transport path and then reaches the secondary transfer region Tr.

In the secondary transfer region Tr, the toner images on the intermediate transfer belt 20 are secondarily transferred to the recording material P at one time by a transfer electric field formed by the secondary transfer rolls 22.

Thereafter, the recording material P to which the toner images have been transferred is separated from the intermediate transfer belt 20, and transported to the fixing device 60 along the transport path.

The toner images on the recording material P transported to the fixing device 60 are fixed onto the recording material P by the fixing device 60. Thereafter, the recording material P is transported to a recording material discharge unit LA.

Figure 2:
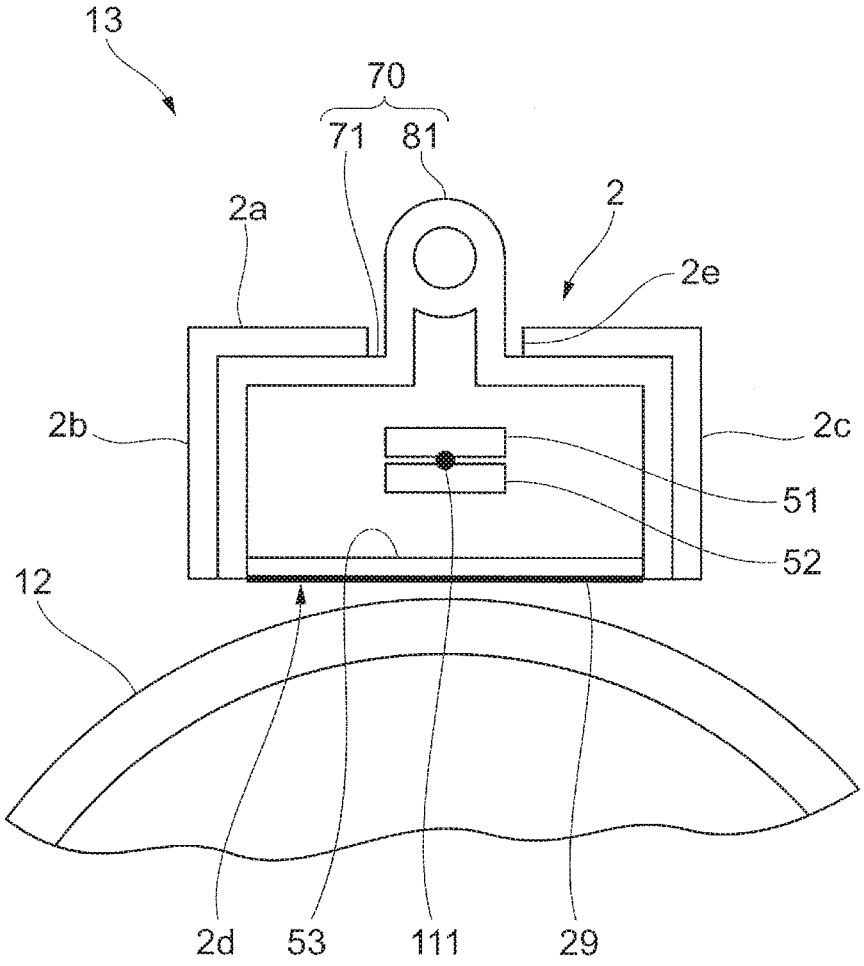
FIG. 2 is an enlarged view of a charging device.

FIG. 2 is an enlarged view of the charging device 13.

As illustrated in FIG. 2, the charging device 13 is provided with a shield electrode 2 that extends in the front and rear direction of the image forming apparatus 1 (see FIG. 1) (in the depth direction of the image forming apparatus 1, that is, in the direction orthogonal to the paper surface in FIG. 2). In other words, the charging device 13 according to the present exemplary embodiment is provided with the shield electrode 2 that extends along the axial direction of each photoconductor drum 12.

The shield electrode 2 is opened at the side thereof directed toward the photoconductor drum 12. In addition, the shield electrode 2 is made of a metallic material. In addition, the shield electrode 2 includes a plate-shaped upper wall portion 2*a* that extends in the front and rear direction of the image forming apparatus 1, and a plate-shaped left wall 2*b* and a plate-shaped right wall 2*c* that extend downwardly from the left and right opposite sides of the upper wall portion 2*a*, respectively.

A wire electrode 111 is provided in the shield electrode 2.

As an example of an electrode, the wire electrode 111 is configured with a wire material, and disposed to face the outer circumferential surface of the photoconductor drum 12. In addition, the wire electrode 111 is disposed along the axial direction of the photoconductor drum 12.

In addition, as illustrated in FIG. 2, a grid electrode 29 is provided in an opening 2*d* of the shield electrode 2.

The grid electrode 29 is disposed to extend in the front and rear direction of the image forming apparatus 1 (in the axial direction of the photoconductor drum 12). In addition, the grid electrode 29 is made of a metallic material in a thin-film shape (plate shape). In addition, the grid electrode 29 includes plural through holes, and the portion where the plural through holes is formed has a mesh shape.

In the present exemplary embodiment, a voltage is applied between the wire electrode 111 and the shield electrode 2 and between the wire electrode 111 and the grid electrode 29. Thus, a potential difference occurs between the wire electrode 111 and the shield electrode 2, and a potential difference occurs between the wire electrode 111 and the grid electrode 29.

Therefore, electrons are emitted from the wire electrode 111, and the surface of the photoconductor drum 12 is charged.

In the present exemplary embodiment, as illustrated in FIG. 2, an upper cleaning member 51 and a lower cleaning member 52 are provided as an example of a cleaning member, and move along the wire electrode 111 and clean the wire electrode 111.

In the present exemplary embodiment, a grid cleaner 53 is disposed to face the grid electrode 29 and configured to clean the grid electrode 29.

In the present exemplary embodiment, a movable member 70 is provided to move along the wire electrode 111 and the grid electrode 29. The upper cleaning member 51, the lower cleaning member 52, and the grid cleaner 53 are attached to the movable member 70, and move together with the movable member 70.

The movable member 70 is provided with a movable member main body 71 that is disposed inside the shield electrode 2 and supports the upper cleaning member 51, the lower cleaning member 52, and the grid cleaner 53.

Further, the movable member 70 is provided with a cylindrical portion 81 through which a shaft 6 to be described later passes.

In the present exemplary embodiment, an opening 2*e* is formed in the upper wall portion 2*a* of the shield electrode 2, and a part of the movable member 70 protrudes through the opening 2*e*.

In the present exemplary embodiment, the cylindrical portion 81 is provided at the protruding portion of the movable member 70. In other words, in the present exemplary embodiment, the cylindrical portion 81 is provided outside the shield electrode 2.

Figure 3:
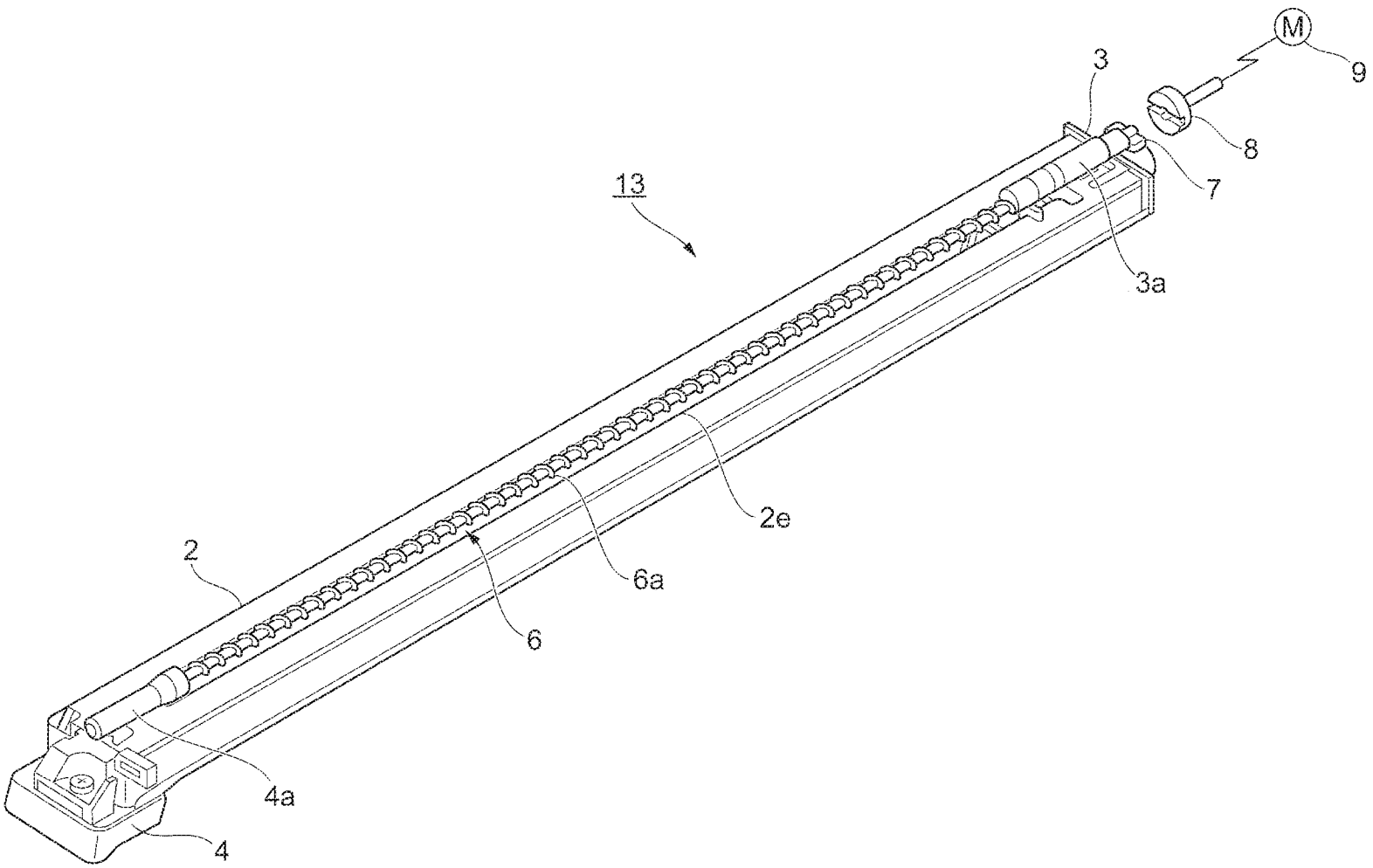
FIG. 3 is a perspective view of the charging device.

FIG. 3 is a perspective view of the charging device 13. In addition, FIG. 3 omits illustration of the movable member 70.

As illustrated in FIG. 3, a rear end block 3 is attached to the rear end (one end portion) of the shield electrode 2, and a front end block 4 is attached to the front end (the other end portion) of the shield electrode 2. In addition, in the present exemplary embodiment, cylindrical shaft support units 3*a* and 4*a* are provided at the end portions of the shield electrode 2 and on the top portion of the shield electrode 2 to extend in the front and rear direction.

In the present exemplary embodiment, the shaft 6 as an example of a rotating member is rotatably supported by the shaft support units 3*a* and 4*a*. The shaft 6 is disposed to extend in the front and rear direction. Additionally, the shaft 6 is disposed along the wire electrode 111 (see FIG. 2) and the grid electrode 29. In addition, a spiral protruding portion (male thread) 6*a* is formed on the outer circumferential surface of the shaft 6.

The rear end portion of the shaft 6 passes through the shaft support unit 3*a* and extends rearward, and a driven coupling 7 is attached to the rear end portion of the shaft 6. The driven coupling 7 is connected to a driving coupling 8 provided at the main body side of the image forming apparatus 1.

In the present exemplary embodiment, the driven coupling 7 receives a driving power from the driving coupling 8 that rotates by a motor 9, and the shaft 6 circumferentially rotates.

The grid electrode 29 illustrated in FIG. 2 is supported by the front end block 4 and the rear end block 3. In addition, the grid electrode 29 is stretched in the longitudinal direction by the front end block 4 and the rear end block 3, and a tension is applied to the grid electrode 29.

One end portion of the wire electrode 111 in the front and rear direction as illustrated in FIG. 2 is fixed to the front end block 4, and the other end portion of the wire electrode 111 is fixed to the rear end block 3.

Figure 4:
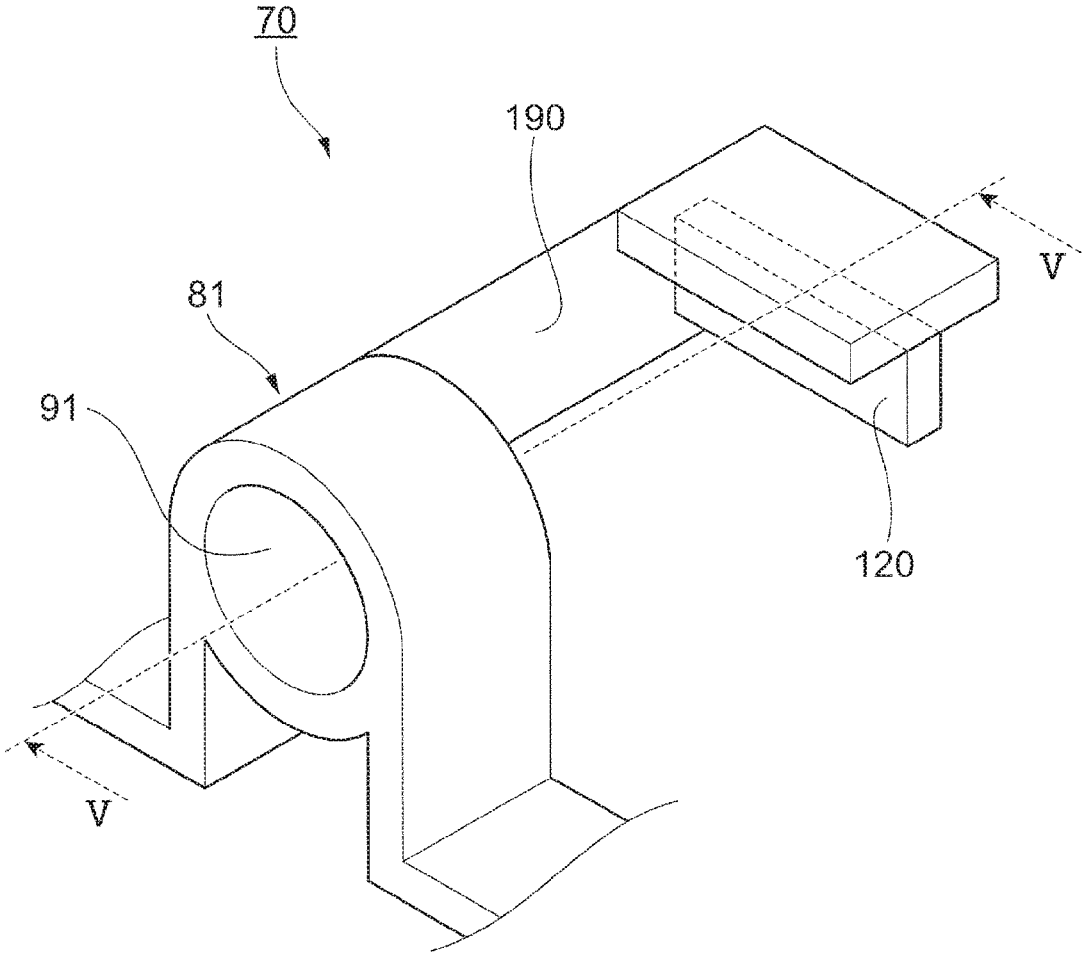
FIG. 4 is a perspective view of a portion of a movable member where a cylindrical portion is provided.
Figure 5:
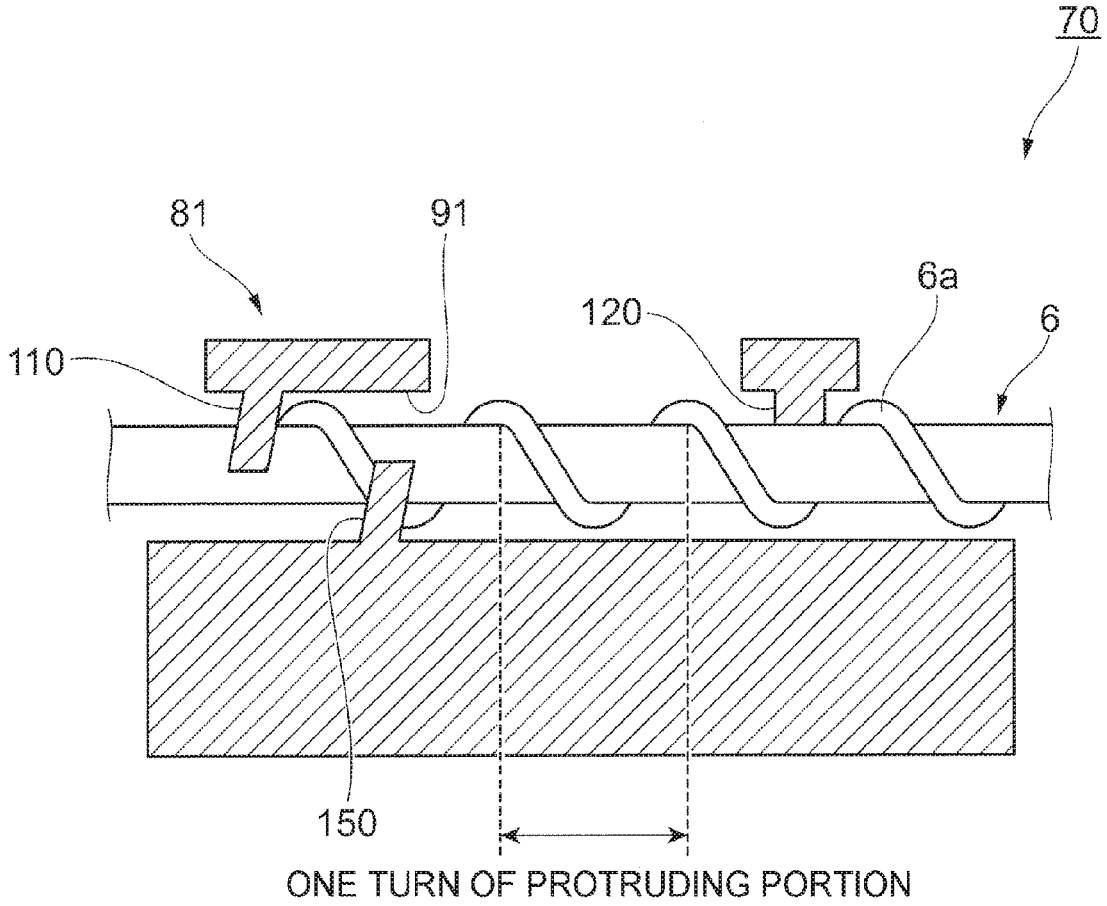
FIG. 5 is a cross-sectional view of the movable member which is taken along the line V-V in FIG. 4.

FIG. 4 is a perspective view of a portion of the movable member 70 where the cylindrical portion 81 is provided. FIG. 5 is a cross-sectional view of the movable member 70 which is taken along the line V-V in FIG. 4. In addition, FIG. 5 illustrates the shaft 6 together.

As illustrated in FIG. 4, the movable member 70 is provided with the cylindrical portion 81. In addition, a through hole 91 (which is an example of a first through hole) is provided inside the cylindrical portion 81 to allow the shaft 6 to pass therethrough.

As illustrated in FIG. 5, a first pressed portion 110 is provided to protrude from the inner circumferential surface of the cylindrical portion 81 and pressed by the protruding portion 6*a* of the shaft 6.

As illustrated in FIGS. 4 and 5, the movable member 70 is provided with a second pressed portion 120 that is pressed by the protruding portion 6*a* of the shaft 6.

The second pressed portion 120 is disposed at a different position from the position of the first pressed portion 110 in the axial direction of the shaft 6. In addition, the second pressed portion 120 is disposed such that one or more turns of the protruding portion 6*a* are positioned between the first pressed portion 110 and the second pressed portion 120.

In the present exemplary embodiment, an opposite pressed portion 150 is provided at the opposite side to the first pressed portion 110 with the shaft 6 interposed therebetween.

Like the first pressed portion 110, the opposite pressed portion 150 is provided to protrude from the inner circumferential surface of the cylindrical portion 81.

In the present exemplary embodiment, when the shaft 6 rotates, the first pressed portion 110, the second pressed portion 120, and the opposite pressed portion 150 are pressed by the protruding portion 6*a*. Therefore, the movable member 70 moves along the axial direction of the shaft 6.

When the movable member 70 moves along the axial direction of the shaft 6, the upper cleaning member 51 (see FIG. 2) and the lower cleaning member 52 move along the wire electrode 111, and the grid cleaner 53 moves along the grid electrode 29 so that the wire electrode 111 and the grid electrode 29 are cleaned.

More specifically, in the present exemplary embodiment, when the movable member 70 moves leftward in FIG. 5, the first pressed portion 110 and the second pressed portion 120 are pressed leftward in FIG. 5 by the protruding portion 6*a* of the circumferentially rotating shaft 6.

When the movable member 70 moves rightward in FIG. 5, the opposite pressed portion 150 is pressed rightward in FIG. 5 by the protruding portion 6*a* of the shaft 6.

Therefore, the movable member 70 moves along the axial direction of the shaft 6 so that the wire electrode 111 and the grid electrode 29 are cleaned.

Here, in the configuration of the present exemplary embodiment, the shaft 6 passes through the through hole 91, and the cylindrical portion 81 is provided to cover the entire circumference of the shaft 6.

Therefore, the displacement of the movable member 70 with respect to the shaft 6 hardly occurs, and the movable member 70 is suppressed from being separated from the shaft 6.

Figure 6A:
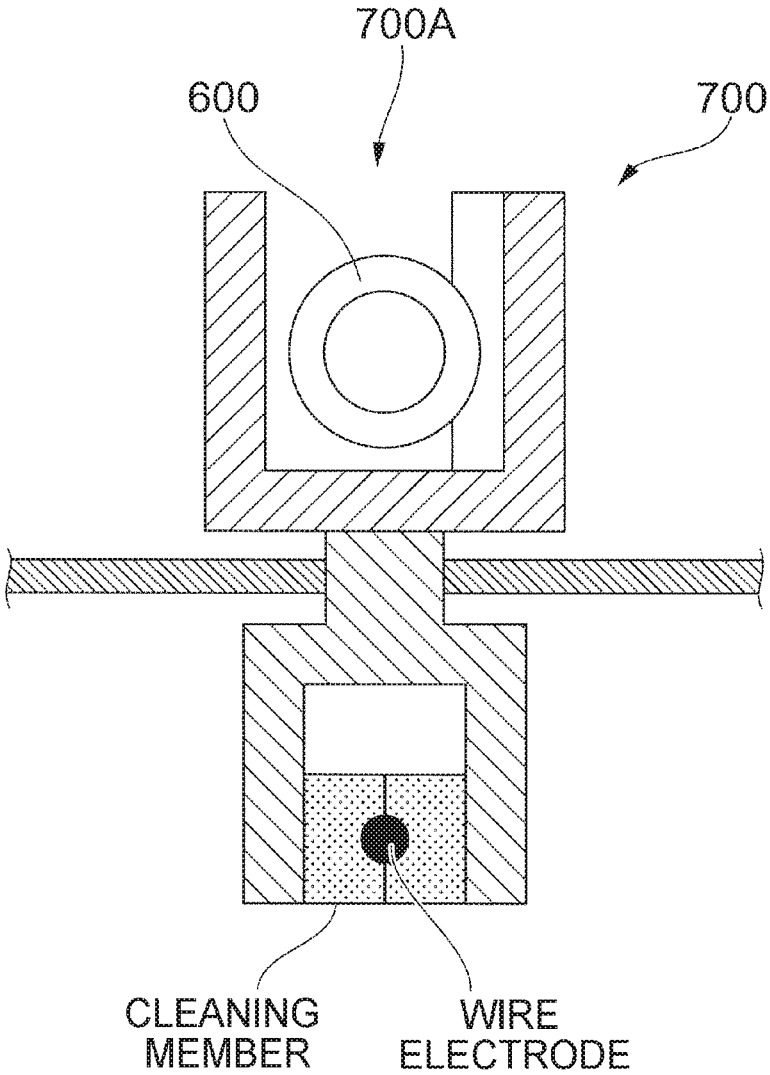
FIGS. 6A and 6B are views illustrating comparative examples of the movable member.
Figure 6B:
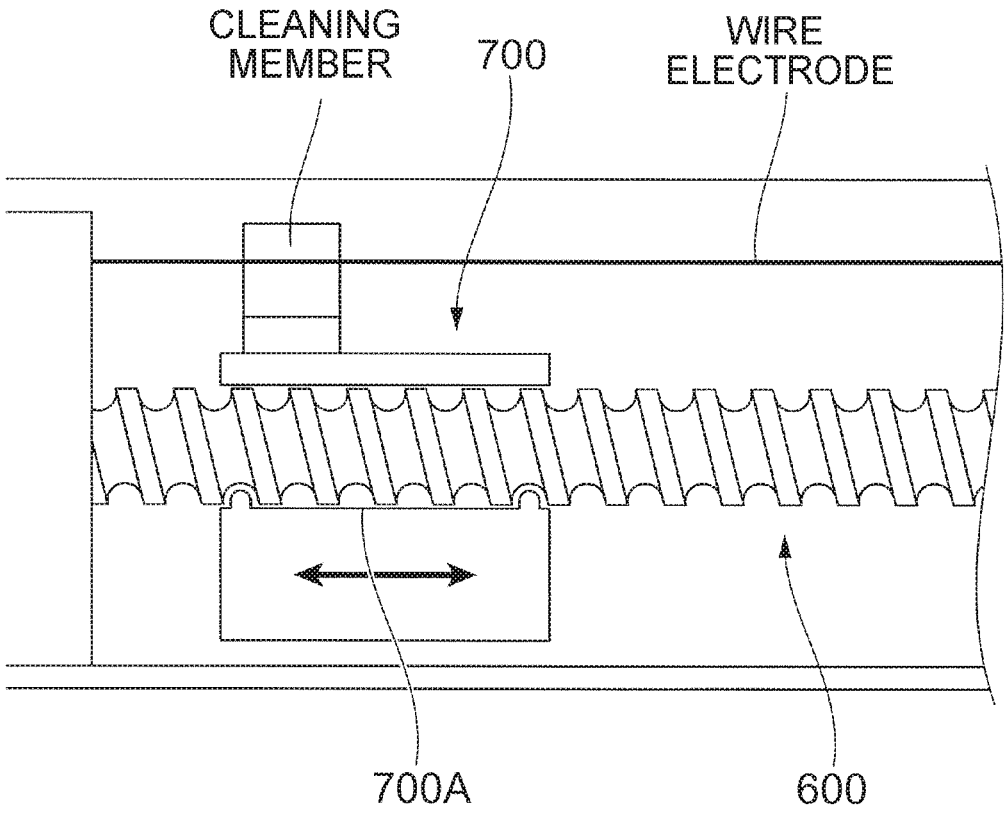

FIGS. 6A and 6B are views illustrating comparative examples of the movable member.

In the comparative example illustrated in FIG. 6A, a shaft 600 passes through a movable member 700 with an opening 700A formed on the top portion thereof. In addition, in the comparative example illustrated in FIG. 6B, an opening 700A is provided at the lateral side of a movable member 700.

In the configuration in which the opening 700A is provided as represented in the comparative examples, the displacement of the movable member 700 with respect to the shaft 600 easily occurs, and the movable member 700 is easily separated from the shaft 600. When a change occurs in the movable member 700, the movable member 700 becomes difficult to move, and in some instances, the movable member 700 is stopped. Further, when the movable member 700 is separated from the shaft 600, the movable member 700 is stopped.

Here, although it may be considered to cover the opening 700A with a separate member, this configuration increases the number of components. Further, the configuration causes complexity of the assembling processes.

In contrast, in the present exemplary embodiment, the shaft 6 passes through the cylindrical portion 81, and the displacement of the movable member 70 with respect to the shaft 6 is inhibited. Further, the movable member 70 is suppressed from being separated from the shaft 6.

In the present exemplary embodiment, the movable member 70 is made of a resin material, and the movable member main body 71 and the cylindrical portion 81, which are illustrated in FIG. 2, are integrally formed. Therefore, the number of components is reduced in comparison with the comparative example in which the opening 700A is covered with a separate member.

In the present exemplary embodiment, as illustrated in FIG. 5, one or more turns of the protruding portion 6*a* are positioned between the first pressed portion 110 and the second pressed portion 120.

Therefore, in the present exemplary embodiment, tilting of the movable member 70 with respect to the shaft 6 hardly occurs, and the movable member 70 more stably moves.

Here, for example, in a configuration in which the second pressed portion 120 is not provided, and two pressed portions, such as the first pressed portion 110 and the opposite pressed portion 150, are provided at positions where the protruding portion 6*a* is interposed, the movable member 70 may easily tilt. Further, in this case, the straight movement stability of the movable member 70 is deteriorated, or the sliding movement resistance acting on the movable member 70 increases.

In contrast, in the configuration in which the two pressed portions, i.e., the first pressed portion 110 and the second pressed portion 120 are provided such that one or more turns of the protruding portion 6*a* are positioned therebetween, as in the present exemplary embodiment, the movable member 70 is difficult to tilt, and the straight movement stability of the movable member 70 increases.

In the configuration illustrated in FIG. 4, a support piece 190 is provided to extend along the axial direction of the shaft 6 (not illustrated in FIG. 4) and configured to support the second pressed portion 120.

The support piece 190 is vertically disposed. In other words, the support piece 190 is disposed along the protruding direction of the second pressed portion 120.

More specifically, the second pressed portion 120 protrudes downwardly from the upper side in FIG. 4, and the support piece 190 is also disposed to be directed downward from the upper side in FIG. 4.

Additionally, the support piece 190 is disposed such that the short length direction of the support piece 190 conforms to the vertical direction. In this case, the displacement of the second pressed portion 120 hardly occurs.

Figure 7:
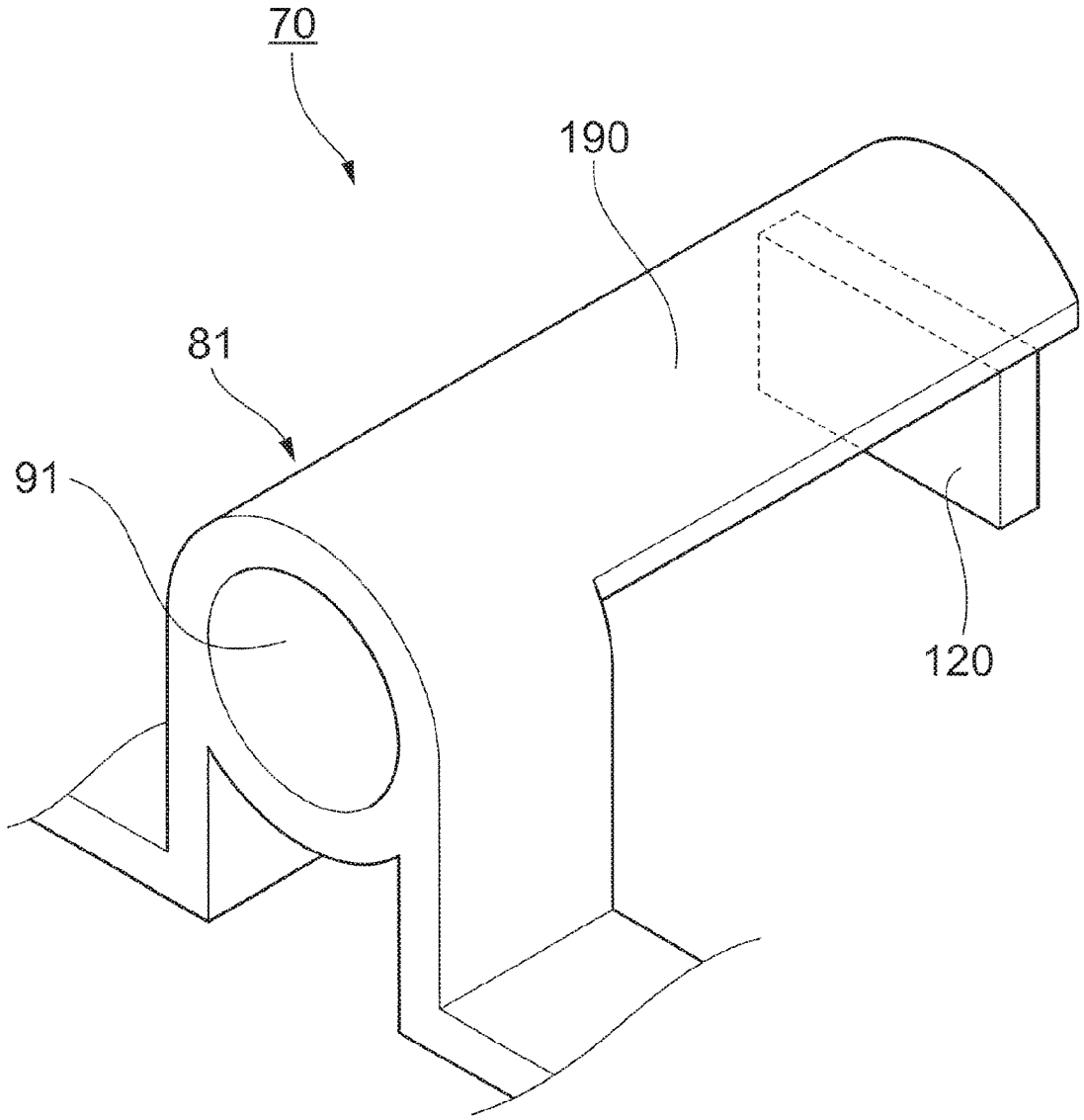
FIG. 7 is a view illustrating another exemplary configuration of the movable member.

Here, for example, as illustrated in FIG. 7 (illustrating another exemplary configuration of the movable member 70), it may be considered that the support piece 190 is positioned above the shaft 6 (not illustrated in FIG. 7).

That is, it may be considered that the support piece 190 is provided to follow the direction orthogonal to the protruding direction of the second pressed portion 120.

In other words, it may be considered that the support piece 190 is provided such that the short length direction of the support piece 190 is orthogonal to the protruding direction of the second pressed portion 120.

Here, in the configuration illustrated in FIG. 7, the support piece 190 is easily bent in the vertical direction in FIG. 7, and the displacement of the second pressed portion 120 (displacement in the direction away from the shaft 6) easily occurs, as compared to the configuration illustrated in FIG. 4. In this case, the driving power becomes difficult to be transmitted from the shaft 6 to the movable member 70.

Figure 8:
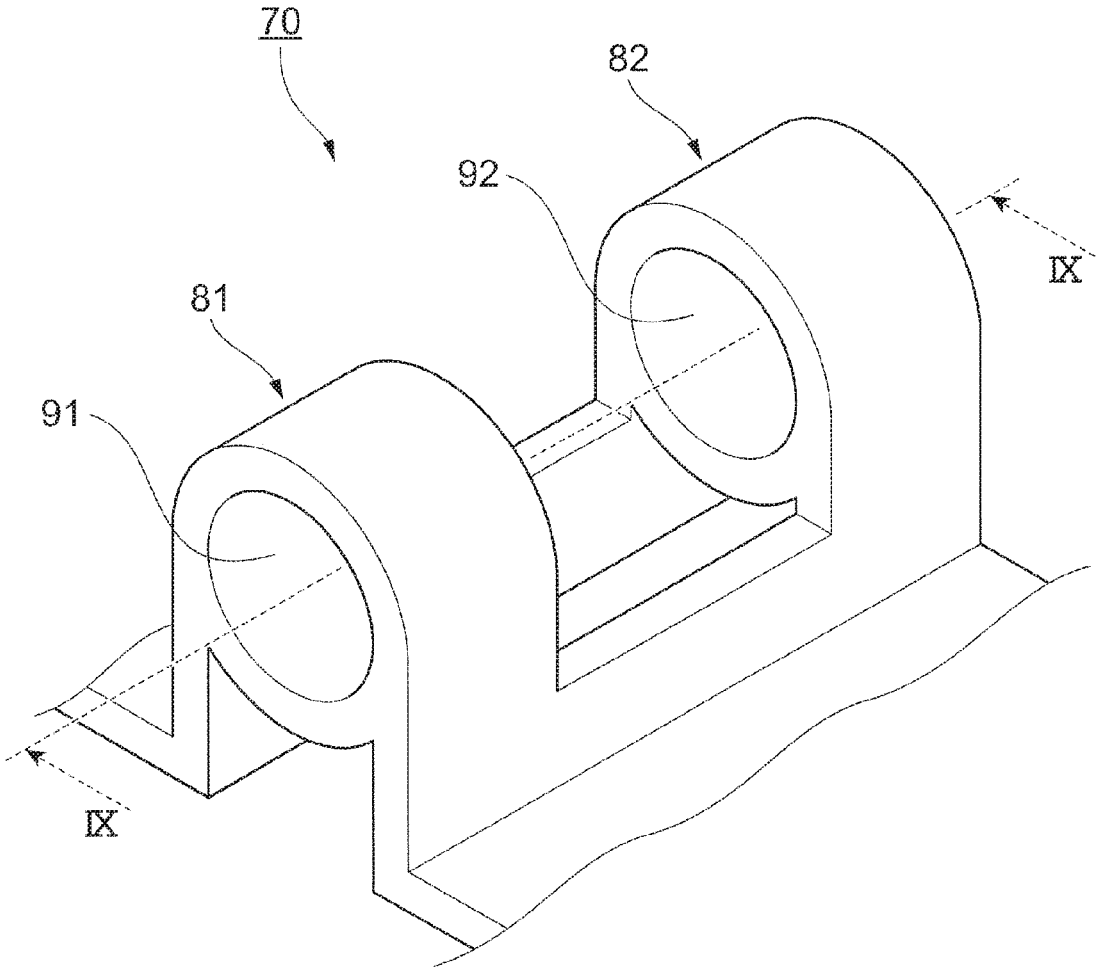
FIG. 8 is a view illustrating another exemplary configuration of the movable member.
Figure 9:
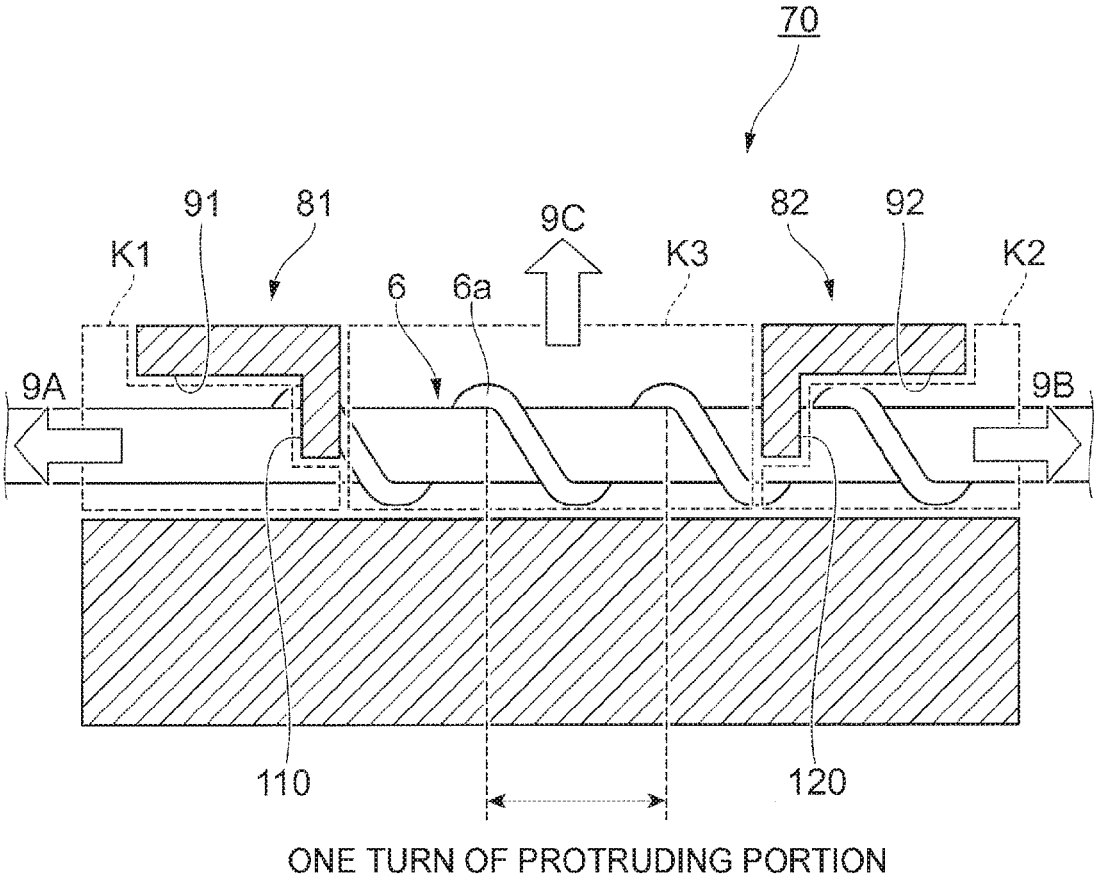
FIG. 9 is a cross-sectional view of the movable member which is taken along the line IX-IX in FIG. 8.

FIG. 8 is a view illustrating another exemplary configuration of the movable member 70. In addition, as in the above descriptions, FIG. 8 illustrates a portion of the movable member 70 where the cylindrical portion 81 is provided. FIG. 9 is a cross-sectional view of the movable member 70 taken along the line IX-IX in FIG. 8. FIG. 9 also illustrates the shaft 6 as in the above descriptions.

In this exemplary configuration, as illustrated in FIG. 8, a second cylindrical portion 82 is provided, and a second through hole 92 is provided inside the second cylindrical portion 82 to allow the shaft 6 to pass therethrough.

The second cylindrical portion 82 is disposed in a state of being spaced apart from the cylindrical portion 81 (hereinafter, referred to as a "first cylindrical portion 81"). In addition, the second cylindrical portion 82 is disposed at a different position from the position of the first cylindrical portion 81 in the axial direction of the shaft 6 (not illustrated in FIG. 8).

In this exemplary configuration, as illustrated in FIG. 9, the second pressed portion 120 is provided on the inner circumferential surface of the second through hole 92.

As in the above descriptions, the second pressed portion 120 is disposed such that one or more turns of the protruding portion 6*a* are positioned between the first pressed portion 110 and the second pressed portion 120.

Here, in the exemplary configuration illustrated in FIG. 9, when the movable member 70 moves leftward in FIG. 9, the first pressed portion 110 is pressed by the protruding portion 6*a* of the shaft 6. In addition, when the movable member 70 moves rightward in FIG. 9, the second pressed portion 120 is pressed by the protruding portion 6*a* of the shaft 6. Therefore, the movable member 70 moves along the axial direction of the shaft 6, and the wire electrode 111 and the grid electrode 29 are cleaned.

In the configuration illustrated in FIG. 9, when the movable member 70 moves leftward (in one direction) in FIG. 9 along the axial direction of the shaft 6, the first pressed portion 110 is pressed by the protruding portion 6*a* of the shaft 6. In this case, the second pressed portion 120 is spaced apart from the protruding portion 6*a*.

Additionally, in the present exemplary embodiment, when the movable member 70 moves in one direction (leftward in FIG. 9), the first pressed portion 110, which is positioned further downstream in the one direction than the second pressed portion 120, is pressed by the protruding portion 6*a*, and in this case, the second pressed portion 120 is spaced apart from the protruding portion 6*a*.

Therefore, for example, the movable member 70 more stably moves, than the case in which the second pressed portion 120 is pressed by the protruding portion 6*a*, and the first pressed portion 110 is spaced apart from the protruding portion 6*a*.

When the movable member 70 moves in the opposite direction (rightward in FIG. 9, and the opposite direction to the one direction), the second pressed portion 120, which is positioned further downstream than the first pressed portion 110 in the opposite direction, is pressed by the protruding portion 6*a* of the shaft 6. In this case, the first pressed portion 110 is spaced apart from the protruding portion 6*a*.

Therefore, for example, the movable member 70 more stably moves, than the case in which the first pressed portion 110 is pressed by the protruding portion 6*a*, and the second pressed portion 120 is spaced apart from the protruding portion 6*a*.

In the exemplary configuration illustrated in FIG. 9, two through holes are provided to allow the shaft 6 to pass therethrough so that the displacement of the movable member 70 with respect to the shaft 6 hardly occurs, as compared to the case in which one through hole is provided.

In the present exemplary embodiment, the second pressed portion 120 is provided on the inner circumferential surface of the second through hole 92 so that the displacement of the second pressed portion 120 with respect to the shaft 6 hardly occurs, as compared to the configuration in FIG. 4 in which no second pressed portion 120 is provided on the inner circumferential surface of the through hole.

When the displacement of the second pressed portion 120 with respect to the shaft 6 hardly occurs, the driving power is easily transmitted from the shaft 6 to the second pressed portion 120.

In addition, in manufacturing the movable member 70 illustrated in FIGS. 8 and 9, three molds including a first mold K1 to a third mold K3 are prepared as illustrated in FIG. 9.

The first mold K1 is disposed at the portion where the through hole 91 is formed. When injection of resin is ended and the first cylindrical portion 81 is formed, the first mold K1 moves in the direction indicated by the arrow 9A in FIG.

9. Additionally, the first mold K1 moves in the direction opposite to the side where the first pressed portion 110 is provided.

The second mold K2 is disposed at the portion where the second through hole 92 is formed. When injection of resin is ended and the second cylindrical portion 82 is formed, the second mold K2 moves in the direction indicated by the arrow 9B in FIG. 9. Additionally, the second mold K2 moves in the direction opposite to the side where the second pressed portion 120 is provided.

The third mold K3 is disposed between the first cylindrical portion 81 and the second cylindrical portion 82. When injection of resin is ended and the first cylindrical portion 81 and the second cylindrical portion 82 are formed, the third mold K3 moves in the direction indicated by the arrow 9C in FIG. 9.

Figure 10:
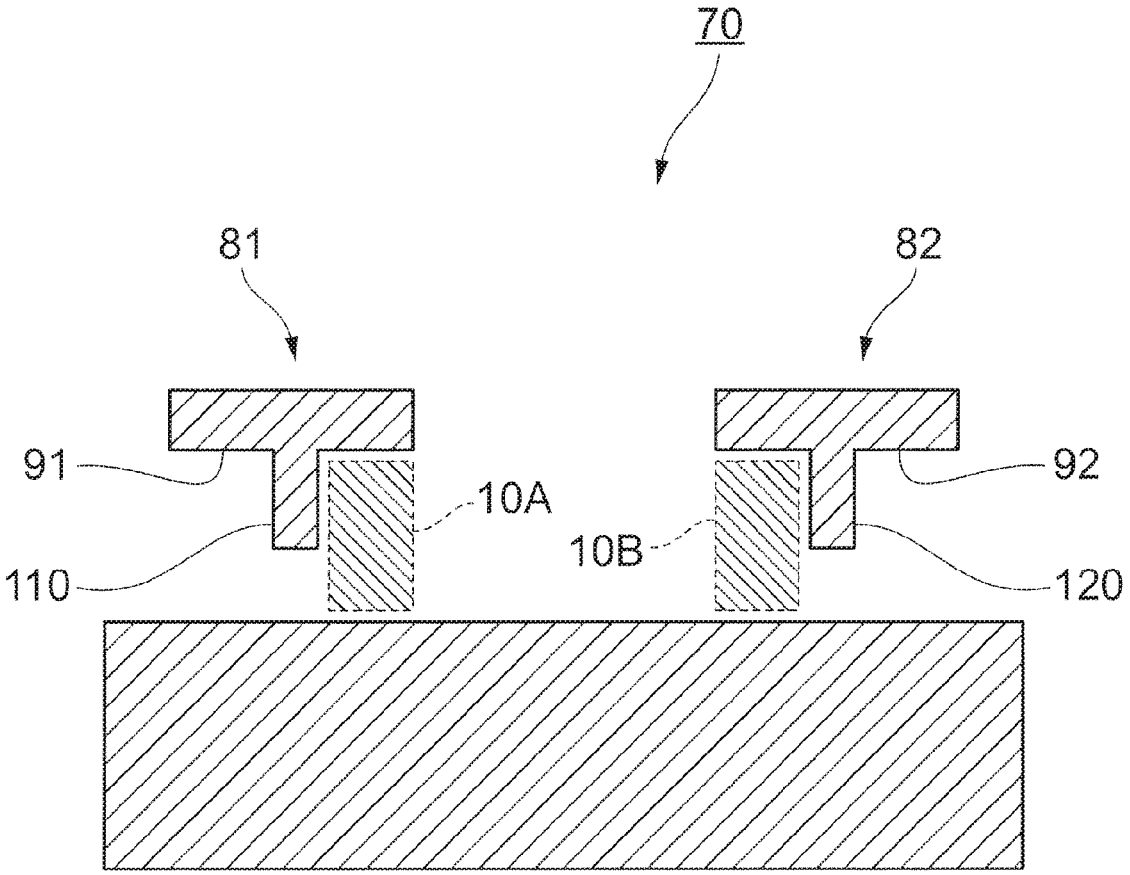
FIG. 10 is a view illustrating another exemplary configuration of the movable member.

FIG. 10 is a view illustrating another exemplary configuration of the movable member 70. In addition, FIG. 10 omits illustration of the shaft 6.

In this exemplary configuration, the first pressed portion 110 is provided at the central portion of the first cylindrical portion 81 in the longitudinal direction thereof, and the second pressed portion 120 is provided at the central portion of the second cylindrical portion 82 in the longitudinal direction thereof. In this case, it is necessary to provide molds even at the portions indicated by the reference numerals 10A and 10B in FIG. 10, which makes the mold structure complicated.

In contrast, in the exemplary configuration illustrated in FIG. 9, the first pressed portion 110 is provided at the end portion of the first cylindrical portion 81 in the axial direction thereof, and the second pressed portion 120 is provided at the end portion of the second cylindrical portion 82 in the axial direction thereof so that it is unnecessary to provide the molds indicated by the reference numerals 10A and 10B.

Figure 11:
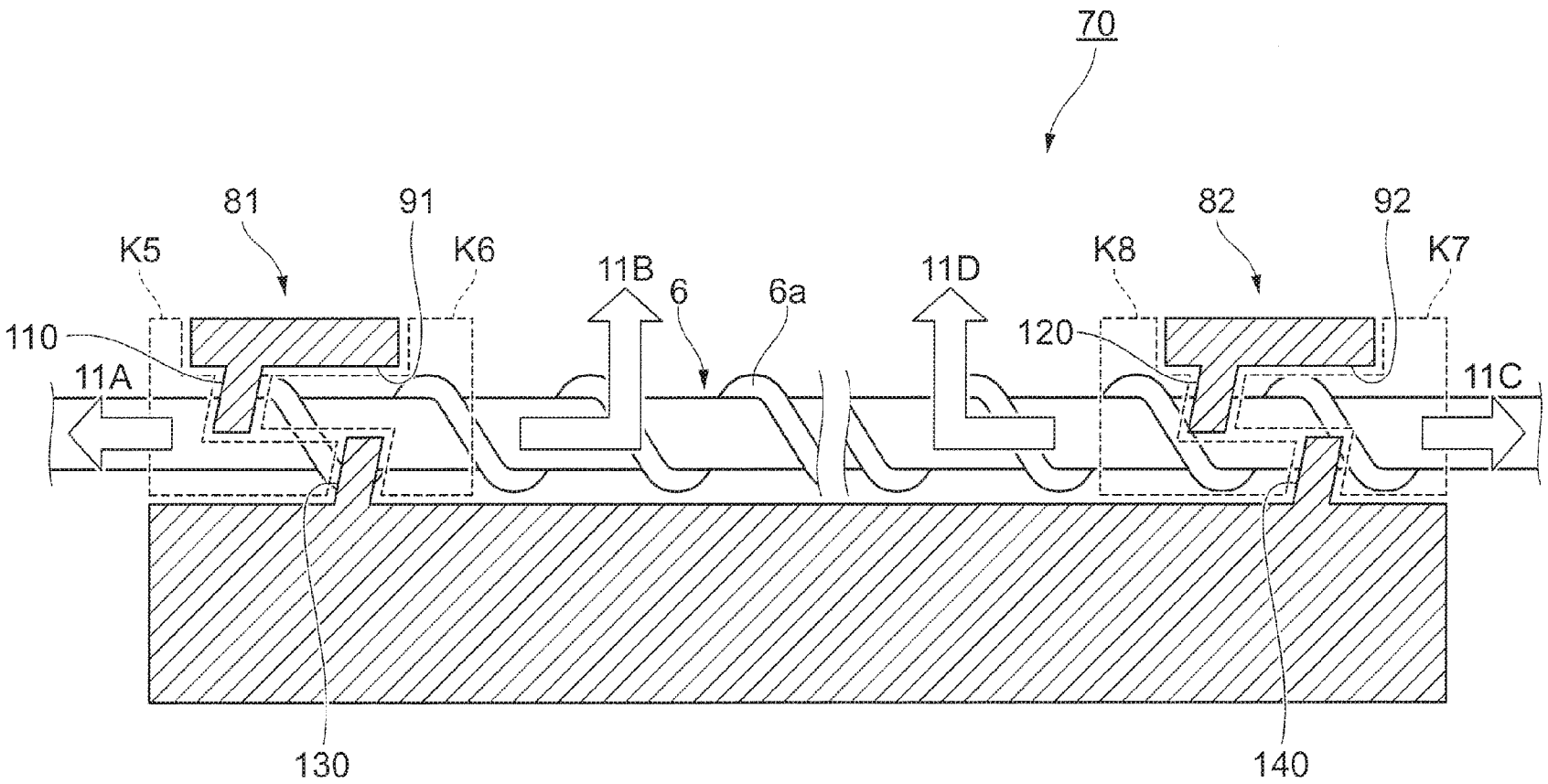
FIG. 11 is a view illustrating another exemplary configuration of the movable member.

FIG. 11 is a view illustrating another exemplary configuration of the movable member 70.

In this exemplary configuration, the distance between the first cylindrical portion 81 and the second cylindrical portion 82 further increases, as compared to the exemplary configuration illustrated in FIG. 9.

In this exemplary configuration, a third pressed portion 130 is provided on the inner circumferential surface of the first cylindrical portion 81 where the first pressed portion 110 is provided, to be pressed by the protruding portion 6*a* of the shaft 6.

Further, a fourth pressed portion 140 is provided on the inner circumferential surface of the second cylindrical portion 82 where the second pressed portion 120 is provided, to be pressed by the protruding portion 6*a* of the shaft 6.

The first pressed portion 110 is provided to protrude downwardly from the ceiling portion of the inner circumferential surface of the first cylindrical portion 81, and the third pressed portion 130 is provided to protrude upwardly from the bottom portion of the inner circumferential surface of the first cylindrical portion 81.

The same configuration is applied to the second cylindrical portion 82, such that the second pressed portion 120 is provided to protrude downwardly from the ceiling portion of the inner circumferential surface of the second cylindrical portion 82, and the fourth pressed portion 140 is provided to protrude upwardly from the bottom portion of the inner circumferential surface of the second cylindrical portion 82.

Here, in the exemplary configuration illustrated in FIG. 11, when the movable member 70 moves leftward in FIG. 11, the first pressed portion 110 and the fourth pressed portion 140 are pressed by the protruding portion 6*a* of the shaft 6. In addition, when the movable member 70 moves rightward in FIG. 11, the second pressed portion 120 and the third pressed portion 130 are pressed by the protruding portion 6*a* of the shaft 6.

Here, in the exemplary configuration illustrated in FIG. 11, since the two pressed portions are provided in the first cylindrical portion 81 and the second cylindrical portion 82, respectively, the displacement of the movable member 70 with respect to the shaft 6 is further difficult to occur. More specifically, the displacement of the movable member 70 with respect to the shaft 6 hardly occurs in comparison with the case in which a single pressed portion is provided on each of the inner circumferential surface of the first cylindrical portion 81 and the inner circumferential surface of the second cylindrical portion 82.

In particular, in the configuration illustrated in FIG. 11, one of the two pressed portions provided on each of the first cylindrical portion 81 and the second cylindrical portion 82 protrudes downwardly from the upper side, and the other one thereof protrudes upwardly from the lower side, such that the protruding directions of the two pressed portions are different from each other.

In this case, the displacement of the movable member 70 with respect to the shaft 6 hardly occurs, for example, in comparison with the case in which the two pressed portions protrude downwardly from the upper side such that the protruding directions of the two pressed portions are in parallel with each other.

In manufacturing the movable member 70 illustrated in FIG. 11, four molds K including a first mold K5 to a fourth mold K8 are prepared as illustrated in FIG. 11.

The first mold K5 and the second mold K6 are disposed at the portion where the first cylindrical portion 81 is formed.

When injection of resin is ended and the first cylindrical portion 81 is formed, the first mold K5 moves in the direction indicated by the arrow 11A in FIG. 11. Additionally, the first mold K5 moves in the direction opposite to the side where the third pressed portion 130 is provided.

When injection of resin is ended and the first cylindrical portion 81 is formed, the second mold K6 moves in the direction indicated by the arrow 11B in FIG. 11. More specifically, the second mold K6 moves in the direction opposite to the side where the first pressed portion 110 is provided, and further moves upwardly.

The third mold K7 and the fourth mold K8 are disposed at the portion where the second cylindrical portion 82 is formed.

When injection of resin is ended and the second cylindrical portion 82 is formed, the third mold K7 moves in the direction indicated by the arrow 11C in FIG. 11. In addition, the third mold K7 moves in the direction opposite to the side where the second pressed portion 120 is provided.

When injection of resin is ended and the second cylindrical portion 82 is formed, the fourth mold K8 moves in the direction indicated by the arrow 11D in FIG. 11. In addition, the fourth mold K8 moves in the direction opposite to the side where the fourth pressed portion 140 is provided, and further moves upwardly.

Here, in the exemplary configuration illustrated in FIG. 11, it is necessary to move the second mold K6 and the fourth mold K8 in the axial direction of the first cylindrical portion 81 and the second cylindrical portion 82, and it is necessary to increase the distance between the first cylindrical portion 81 and the second cylindrical portion 82 in comparison with the configuration illustrated in FIG. 9.

In the exemplary configuration illustrated in FIG. 9, the third mold K3 has only to move upwardly as indicated by the arrow 9C. However, in the exemplary configuration illustrated in FIG. 11, a space is required to move the second mold K6 and the fourth mold K8 in the axial direction of the first cylindrical portion 81 and the second cylindrical portion 82, and as a result, the distance between the first cylindrical portion 81 and the second cylindrical portion 82 increases.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

an electrode;

a cleaning member configured to move along the electrode and to clean the electrode;

a rotating member that is disposed along the electrode, includes a spiral protruding portion on an outer circumferential surface thereof, and is configured to circumferentially rotate; and a movable member to which the cleaning member is attached, the movable member including:

a first through hole through which the rotating member passes;

a first pressed portion that is provided on an inner circumferential surface of the first through hole and is configured to be pressed by the protruding portion of the rotating member; and a second pressed portion that is disposed outside of the first through hole in an axial direction of the rotating member and that is configured to be pressed by the protruding portion, wherein upon receiving driving power from the rotating member, the movable member moves in the axial direction of the rotating member.

2. The charging device according to claim 1, wherein the second pressed portion is disposed such that at least one whole turn of the protruding portion is positioned between the second pressed portion and the first pressed portion in the axial direction of the rotating member.

3. The charging device according to claim 1, wherein the movable member is configured without any other through hole through which the rotating member passes except for the first through hole.

4. The charging device according to claim 1, wherein the second pressed portion has a different shape from a shape of the first pressed portion.

5. A charging device comprising:

an electrode;

a cleaning member configured to move along the electrode and to clean the electrode;

a rotating member that is disposed along the electrode, includes a spiral protruding portion on an outer circumferential surface thereof, and is configured to circumferentially rotate; and a movable member to which the cleaning member is attached, the movable member including:

a first through hole through which the rotating member passes;

a first pressed portion that is provided on an inner circumferential surface of the first through hole and is configured to be pressed by the protruding portion of the rotating member; and a second pressed portion that is disposed at a different position from a position of the first pressed portion in an axial direction of the rotating member and that is disposed such that one or more turns of the protruding portion are positioned between the second pressed portion and the first pressed portion, the second pressed portion being configured to be pressed by the protruding portion, wherein upon receiving driving power from the rotating member, the movable member moves in the axial direction of the rotating member, wherein a second through hole through which the rotating member passes is further provided at a position different from a position of the first through hole in the axial direction of the rotating member.

6. The charging device according to claim 5, wherein the second pressed portion is provided on an inner circumferential surface of the second through hole.

7. The charging device according to claim 6, wherein a third pressed portion, that is pressed by the protruding portion of the rotating member, is further provided on the inner circumferential surface on which the first pressed portion is provided, and a fourth pressed portion, that is pressed by the protruding portion of the rotating member, is further provided on the inner circumferential surface on which the second pressed portion is provided.

8. A charging device comprising:

an electrode;

a cleaning member configured to move along the electrode and to clean the electrode;

a rotating member that is disposed along the electrode, includes a spiral protruding portion on an outer circumferential surface thereof, and is configured to circumferentially rotate; and a movable member to which the cleaning member is attached, the movable member including:

a first through hole through which the rotating member passes;

a first pressed portion that is provided on an inner circumferential surface of the first through hole and is configured to be pressed by the protruding portion of the rotating member; and a second pressed portion that is disposed at a different position from a position of the first pressed portion in an axial direction of the rotating member and that is disposed such that one or more turns of the protruding portion are positioned between the second pressed portion and the first pressed portion, the second pressed portion being configured to be pressed by the protruding portion, wherein upon receiving driving power from the rotating member, the movable member moves in the axial direction of the rotating member, wherein when the movable member moves in one direction along the axial direction of the rotating member, one of the first pressed portion and the second pressed portion, that is positioned downstream in the one direction, is pressed by the protruding portion, and the other of the first pressed portion and the second pressed portion is spaced apart from the protruding portion, and when the movable member moves in an opposite direction to the one direction, the other pressed portion is pressed by the protruding portion, and the one pressed portion is spaced apart from the protruding portion.

9. An image forming apparatus comprising:

an image carrier that is rotatably provided;

an electrode that is disposed at a position where the electrode faces an outer circumferential surface of the image carrier, and extends along an axial direction of the image carrier;

a cleaning member configured to move along the electrode and clean the electrode;

a rotating member that is disposed along the electrode, includes a spiral protruding portion on an outer circumferential surface thereof, and is configured to circumferentially rotate; and a movable member to which the cleaning member is attached, the movable member including:

a through hole through which the rotating member passes;

a first pressed portion that is provided on an inner circumferential surface of the through hole and is configured to be pressed by the protruding portion of the rotating member; and a second pressed portion that is disposed outside of the first through hole in an axial direction of the rotating member and that is configured to be pressed by the protruding portion, wherein upon receiving driving power from the rotating member, the movable member moves in the axial direction of the rotating member.

10. A charging device comprising:

an electrode;

a cleaning member configured to move along the electrode and to clean the electrode;

a rotating member that is disposed along the electrode, includes a spiral protruding portion on an outer circumferential surface thereof, and is configured to circumferentially rotate; and a movable member to which the cleaning member is attached, the movable member including:

a first through hole through which the rotating member passes;

a first pressed portion that is provided on an inner circumferential surface of the first through hole and is configured to be pressed by the protruding portion of the rotating member; and a second pressed portion that is disposed at a different position from a position of the first pressed portion in an axial direction of the rotating member and that is disposed such that at least one whole turn of the protruding portion is positioned between the second pressed portion and the first pressed portion in the axial direction of the rotating member, the second pressed portion being configured to be pressed by the protruding portion, wherein upon receiving driving power from the rotating member, the movable member moves in the axial direction of the rotating member.

* * * * *